US011518948B1

(12) United States Patent
Alroaithi et al.

(10) Patent No.: US 11,518,948 B1
(45) Date of Patent: Dec. 6, 2022

(54) METHODS FOR BREAKING EMULSIONS

(71) Applicant: Saudi Arabian Oil Company, Dhahran (SA)

(72) Inventors: Mohammad S. Alroaithi, Thuwal (SA); Muhammad Imran Ul-haq, Dhahran (SA); Shaikh Sohel, Dhahran (SA); Wei Xu, Thuwal (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/409,107

(22) Filed: Aug. 23, 2021

(51) Int. Cl.
*C10G 33/04* (2006.01)

(52) U.S. Cl.
CPC ..... *C10G 33/04* (2013.01); *C10G 2300/308* (2013.01)

(58) Field of Classification Search
CPC ..... C10G 33/04; C10G 2300/308
See application file for complete search history.

(56) References Cited

U.S. PATENT DOCUMENTS

| | | | |
|---|---|---|---|
| 4,267,120 | A | 5/1981 | Cuscurida et al. |
| 4,382,853 | A | 5/1983 | McCoy |
| 4,384,950 | A | 5/1983 | McCoy |
| 4,435,548 | A | 3/1984 | Tomalia et al. |
| 6,066,755 | A | 5/2000 | Koch et al. |
| 8,247,520 | B2 | 8/2012 | Allen et al. |
| 8,618,180 | B2 | 12/2013 | Bruchmann et al. |
| 10,011,758 | B2 | 7/2018 | McWilliams et al. |
| 10,067,352 | B2 | 9/2018 | Alderman |
| 2007/0100002 | A1 | 5/2007 | Leinweber et al. |
| 2008/0153931 | A1 | 6/2008 | Bruchmann et al. |
| 2008/0312384 | A1 | 12/2008 | Bruchmann et al. |
| 2009/0197978 | A1 | 8/2009 | Patel et al. |
| 2010/0120984 | A1 | 5/2010 | Ozawa et al. |
| 2011/0230580 | A1 | 9/2011 | Allen et al. |
| 2012/0095112 | A1 | 4/2012 | Findlay et al. |
| 2013/0324446 | A1 | 12/2013 | Qu et al. |
| 2016/0200962 | A1 | 7/2016 | McWilliams et al. |

FOREIGN PATENT DOCUMENTS

| | | | |
|---|---|---|---|
| CA | 2699713 | A1 | 4/2009 |
| EP | 0264841 | A2 | 4/1988 |
| GB | 2365020 | * | 2/2002 |
| WO | 9722577 | A1 | 6/1997 |
| WO | 2007092631 | A2 | 8/2007 |
| WO | 2010076253 | A1 | 7/2010 |

OTHER PUBLICATIONS

Wang et al., "Carbon dioxide-based functional polycarbonates: Metal catalyzed copolymerization of CO2 and epoxides", Coordination Chemistry Reviews, vol. 372, pp. 85-100, 2018.

* cited by examiner

*Primary Examiner* — Thuan D Dang
(74) *Attorney, Agent, or Firm* — Dinsmore & Shohl LLP

(57) ABSTRACT

A method for breaking an emulsion may include contacting the emulsion with an emulsion-breaking solution to coalesce a dispersed phase and obtain a discrete boundary between an aqueous phase and an oleaginous phase. The emulsion may include a continuous phase and a dispersed phase dispersed within the continuous phase. The emulsion breaking solution includes an emulsion breaking compound that includes carbonate-link monomers and ether-link monomers. The carbonate-link monomers and ether-link monomers may be independently substituted with substituted or unsubstituted ($C_1$-$C_{50}$) linear or branched hydrocarbyl, substituted or unsubstituted ($C_3$-$C_{50}$) cyclohydrocarbyl, substituted or unsubstituted ($C_4$-$C_{50}$) aryl, —$NH_2$, alkyl amines, alkoxylated amines, and substituted or unsubstituted ($C_1$-$C_{50}$) linear or branched heterohydrocarbyl.

19 Claims, No Drawings

METHODS FOR BREAKING EMULSIONS

TECHNICAL FIELD

Embodiments of the present disclosure generally relate to methods for breaking emulsions and, more specifically, to chemical methods for breaking emulsions.

BACKGROUND

Crude oil and water may from emulsions at various stages of crude oil production and processing. Emulsions may form or be present inside the reservoir, in the wellbore, in the wellhead, at wet crude handling facilities, at gas/oil separation facilities, at crude oil storage facilities, and during crude oil transportation through pipelines. The presence of water in the crude oil may have undesirable consequences such as the corrosion of refinery equipment, poisoning catalyst in downstream processing facilities, and increasing the pumping cost of the crude oil. Conventional techniques for demulsifying crude oil and water include chemical, mechanical, electrical, and thermal techniques. Chemical techniques for breaking emulsions generally include mixing the emulsion with a chemical demulsifier to increase the rate of separation of the components of the emulsion. Such techniques may allow the crude oil and water to be separated. Accordingly, there is a need for improved method for breaking emulsions of crude oil and water.

SUMMARY

Embodiments of the present disclosure address at least some of these problems and are related to methods for breaking emulsions that include contacting the emulsion with an emulsion-breaking compound. The emulsion-breaking compound may include a carbon dioxide based polycarbonate. Using a carbon dioxide based polycarbonate as the emulsion-breaking compound may provide a valuable use for carbon dioxide. Accordingly, the methods for breaking emulsions contemplated in the present disclosure may provide a valuable use for carbon dioxide while preventing at least some of the undesired consequences of water passing through a crude-oil processing system.

According to one or more embodiments, a method for breaking an emulsion may include contacting the emulsion with an emulsion-breaking solution to coalesce the dispersed phase and obtain a discrete boundary between an aqueous phase and an oleaginous phase. The emulsion may include a continuous phase and a dispersed phase dispersed within the continuous phase. The emulsion-breaking solution includes a demulsifier compound according to formula (I):

(I)

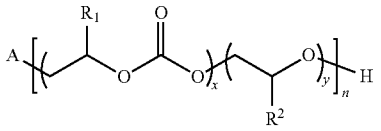

In formula (I), $R^1$ and $R^2$ are independently selected from substituted or unsubstituted ($C_1$-$C_{50}$) linear or branched hydrocarbyl, substituted or unsubstituted ($C_3$-$C_{50}$) cyclohydrocarbyl, substituted or unsubstituted ($C_4$-$C_{50}$) aryl, —$NH_2$, alkyl amines, alkoxylated amines, and substituted or unsubstituted ($C_1$-$C_{50}$) linear or branched heterohydrocarbyl. A is a starter moiety or a terminal group. x is a mole fraction of carbonate-link monomers of the demulsifier compound. y is a mole fraction of ether-link monomers of the demulsifier compound. x is from 0.001 to 1, y is from 0 to 0.999, and x+y=1. n is a number of repeat units that provides the demulsifier compound a molecular weight from 200 g/mol to 250,000 g/mol.

Additional features and advantages of the described embodiments will be set forth in the detailed description that follows, and in part will be readily apparent to those skilled in the art from that description or recognized by practicing the described embodiments, including the detailed description that follows and the claims.

DETAILED DESCRIPTION

The detailed description discloses one or more embodiments relevant to the appended claims. One or more embodiments of the present disclosure are directed to methods for breaking emulsions. The methods for breaking emulsions generally comprise contacting an emulsion with an emulsion-breaking solution to coalesce a dispersed phase and obtain a discrete boundary between an aqueous phase and an oleaginous phase. It should be understood that the emulsion-breaking methods and associated emulsion-breaking solutions may be embodied in different forms and should not be construed as limited to the specific embodiments set forth in this disclosure. Rather, embodiments are provided so that this disclosure will be thorough and complete, and will fully convey the scope of the subject matter to those skilled in the art.

The term "independently selected" is used herein with respect to variable chemical groups to indicate that the variable groups may be identical or different, without regard to the identity of any other variable group.

When used to describe certain carbon atom-containing chemical groups, a parenthetical expression having the form "($C_x$-$C_y$)" means that the unsubstituted form of the chemical group has from x carbon atoms to y carbon atoms, inclusive of x and y. For example, a ($C_1$-$C_{50}$) alkyl is an alkyl group having from 1 to 50 carbon atoms in its unsubstituted form. In some embodiments and general structures, certain chemical groups may be substituted by one or more substituents. A substituted chemical group defined using the "($C_x$-$C_y$)" parenthetical may contain more than y carbon atoms depending on the identity of any substituents. For example, a "($C_1$-$C_{50}$) alkyl substituted with exactly one phenyl (—$C_6H_5$)" may contain from 7 to 56 carbon atoms. Thus, in general when a chemical group defined using the "($C_x$-$C_y$)" parenthetical is substituted by one or more carbon atom-containing substituents, the minimum and maximum total number of carbon atoms of the chemical group is determined by adding to both x and y the combined sum of the number of carbon atoms from all of the carbon atom-containing substituents.

The term "substitution" means that at least one hydrogen atom (—H) bonded to a carbon atom or heteroatom of a corresponding unsubstituted compound or functional group is replaced by a substituent. Substituents may be any suitable functional group or radical that could replace a hydrogen atom bonded to a carbon atom or heteroatom of a corresponding unsubstituted compound. For example, substituents may include, but are not limited to, hydrocarbyls, cyclohydrocarbyls, aryls, alkyl-phenyls, and amines.

The term "—H" means a hydrogen or hydrogen radical that is covalently bonded to another atom. "Hydrogen" and "—H" are interchangeable, and unless clearly specified have identical meanings.

The term "hydrocarbyl" means a monovalent radical resulting from removal of any hydrogen atom from a hydrocarbon, including aromatic hydrocarbons, non-aromatic hydrocarbons, cyclic or acyclic hydrocarbons, saturated or unsaturated hydrocarbons, straight chain or branched chain hydrocarbons, and substituted or unsubstituted hydrocarbons.

The term "heterohydrocarbyl" refers to a hydrocarbyl, from which at least one carbon atom has been replaced with a heteroatom. Examples of heteroatoms include, without limitation, oxygen, nitrogen, sulfur, and phosphorus.

The term "cyclohydrocarbyl" means an aromatic or non-aromatic, cyclic hydrocarbyl having at least three carbon atoms, including monocyclic and polycyclic hydrocarbyls, fused and non-fused polycyclic hydrocarbyls, and bicyclic hydrocarbyls, non-aromatic saturated or unsaturated cyclic hydrocarbyls, and substituted or unsubstituted hydrocarbyls.

The term "aryl" means an aromatic hydrocarbon radical, in which the carbon atoms of the aromatic system may be substituted or unsubstituted. Aryls include monocyclic, bicyclic and tricyclic aromatic hydrocarbon radicals. A monocyclic aromatic hydrocarbon radical includes one aromatic ring; a bicyclic aromatic hydrocarbon radical has two rings; and a tricyclic aromatic hydrocarbon radical has three rings. When the bicyclic or tricyclic aromatic hydrocarbon radical is present, at least one of the rings of the radical is aromatic. The other ring or rings of the aromatic radical may be independently fused or non-fused and aromatic or non-aromatic. Non-limiting examples of aryls include phenyl; fluorenyl; tetrahydrofluorenyl; indacenyl; hexahydroindacenyl; indenyl; dihydroindenyl; naphthyl; tetrahydronaphthyl; and phenanthrenyl.

The term "alkyl" means a saturated hydrocarbon radical that may be straight-chain or branched. Accordingly, the term "($C_1$-$C_{20}$) alkyl" means a saturated straight or branched hydrocarbon radical of from 1 to 20 carbon atoms that is unsubstituted or substituted. Examples of unsubstituted ($C_1$-$C_{20}$) alkyl include methyl; ethyl; 1-propyl; 2-propyl; 1-butyl; 2-butyl; 2-methylpropyl; 1,1-dimethylethyl; 1-pentyl; 1-hexyl; 1-heptyl; 1-nonyl; and 1-decyl. Examples of substituted ($C_1$-$C_2$M) alkyl include trifluoromethyl and trifluoroethyl.

The term "cycloalkyl" means a saturated cyclic hydrocarbon radical. Accordingly, the term "($C_3$-$C_{20}$) cycloalkyl" means a saturated cyclic hydrocarbon radical of from 3 to 20 carbon atoms that is unsubstituted or substituted. Other cycloalkyl groups (e.g., ($C_x$-$C_y$) cycloalkyl) are defined in an analogous manner as having from x to y carbon atoms and being either unsubstituted or substituted. Non-limiting examples of ($C_3$-$C_{40}$) cycloalkyl include cyclopropyl, cyclobutyl, cyclopentyl, cyclohexyl, cycloheptyl, cyclooctyl, cyclononyl, and cyclodecyl, any of which may be substituted or unsubstituted.

The term "($C_1$-$C_2$M) alkyl-phenyl" means an alkyl having from 1 to 20 carbon atoms, of which, a phenyl substitution is present at the end of the alkyl chain, if the alkyl chain is straight, or at the end of the longest chain, if the alkyl is branched. Non-limiting examples of ($C_1$-$C_{20}$) alkyl-phenyl include phenylmethyl, 2-phenylethyl, 3-phenylpropyl, and 4-phenylbutyl.

The term "amine" means a compound having the general structure —$NR^1R^2$ where R is independently selected from —H and substituted or unsubstituted, linear or branched hydrocarbyl or heterohydrocarbyl. Amines may be primary amines, secondary amines and tertiary amines. When $R^1$ and $R^2$ are both —H, the amine is a primary amine. When either $R^1$ or $R^2$ but not both are —H, the amine is a secondary amine. When neither $R^1$ nor $R^2$ is —H, the amine is a tertiary amine. The term "alkyl amine" means an amine where either $R^1$ or $R^2$ or both $R^1$ and $R^2$ are alkyl, such as methyl or ethyl, for example.

The term "saturated" means lacking carbon-carbon double bonds, carbon-carbon triple bonds, and (in heteroatom-containing groups) carbon-nitrogen, carbon-phosphorous, and carbon-silicon double bonds. Where a saturated chemical group is substituted by one or more substituents, one or more double and/or triple bonds optionally may be present in substituents. The term "unsaturated" means containing one or more carbon-carbon double bonds or carbon-carbon triple bonds, or (in heteroatom-containing groups) one or more carbon-nitrogen double bonds, carbon-phosphorous double bonds, or carbon-silicon double bonds, not including double bonds that may be present in substituents, if any, or in aromatic rings or heteroaromatic rings, if any.

Reference will now be made in detail to embodiments of emulsion-breaking methods. According to embodiments, methods for breaking emulsions may comprise contacting the emulsion with an emulsion-breaking solution to coalesce a dispersed phase and obtain a discrete boundary between an aqueous phase and an oleaginous phase.

In one or more embodiments, contacting the emulsion with the emulsion-breaking solution may be performed in any suitable vessel. For example, the emulsion and the emulsion-breaking solution may be contacted in a tank, a reactor, a drum, a barrel, a vat, a pipe, a tube, or any other suitable vessel. In one or more embodiments, emulsion and the emulsion-breaking solution may be mixed. For example, the emulsion and emulsion-breaking solution may be mixed with a static mixer or an active mixer, such as a motorized impeller. In alternative embodiments, the emulsion and emulsion-breaking solution may be mixed manually.

Generally, the emulsion comprises a continuous phase and a dispersed phase. In embodiments, the continuous phase may comprise water and the dispersed phase may comprise oil. Such emulsions may be referred to as "oil-in-water emulsions." Water present in the continuous phase may include freshwater, saltwater, formation water, produced water, or any other suitable water. In embodiments, the oil includes crude oil.

In one or more embodiments, the continuous phase may comprise oil and the dispersed phase may comprise water. Such emulsions may be referred to a "water-in-oil emulsions." In embodiments, the oil in such emulsions includes crude oil, and the water may include freshwater, saltwater, formation water, produced water, or any other suitable water.

In one or more embodiments, the continuous phase may comprise oil and the dispersed phase may comprise a second emulsion. The second emulsion may comprise a second continuous phase and a second dispersed phase, where the second continuous phase comprises water and the second dispersed phase comprises oil. Such emulsions may be referred to as "oil-in-water-in-oil emulsions." In embodiments, the oil in such emulsions includes crude oil, and the water may include freshwater, saltwater, formation water, produced water, or any other suitable water.

In one or more embodiments, the emulsion-breaking solution comprises a demulsifier compound according to formula (I):

(I)

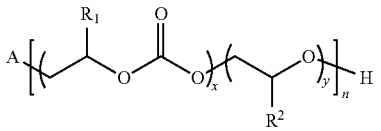

In formula (I), $R^1$ and $R^2$ are independently selected from substituted or unsubstituted ($C_1$-$C_{50}$) linear or branched hydrocarbyl, substituted or unsubstituted ($C_3$-$C_{50}$) cyclohydrocarbyl, substituted or unsubstituted ($C_4$-$C_{50}$) aryl, —$NH_2$, alkyl amine, alkoxylated amine, and substituted or unsubstituted ($C_1$-$C_{50}$) linear or branched heterohydrocarbyl. In one or more embodiments, $R^1$ and $R^2$ are identical to each other. In one or more embodiments, $R^1$ and $R^2$ are not identical to each other. In some embodiments, all instances of $R^1$ in a single molecule are identical to each other, and all instances of $R^2$ in a single molecule are identical to each other, where $R^1$ and $R^2$ generally may be identical to each other or not identical to each other. In some embodiments, a single molecule may include some instances of $R^1$ that differ from other instances of $R^1$, or some instances of $R^2$ that differ from other instances of $R^2$, where all, instances, some instances, or no instances of $R^1$ may be identical to a corresponding instance of $R^2$. In example embodiments, $R^1$ and $R^2$ are independently selected from unsubstituted ($C_1$-$C_{50}$) linear or branched hydrocarbyls. In further example embodiments, $R^1$ and $R^2$ are independently selected from unsubstituted ($C_1$-$C_{50}$) linear hydrocarbyls.

In embodiments, each of the substituted or unsubstituted, linear or branched hydrocarbyl, substituted or unsubstituted cyclohydrocarbyl, the substituted or unsubstituted aryl, and the substituted or unsubstituted, linear or branched heterohydrocarbyl of $R^1$ or $R^2$ may comprise up to and including 1000 carbon atoms in an unsubstituted form. For example, when using the form "($C_x$-$C_y$)" to describe the number of carbon atoms in the hydrocarbyl, cyclohydrocarbyl, aryl, or heterohydrocarbyl of $R^1$ or $R^2$, y may be 1000, 700, 500, 300, 200, 100, 90, 80, 70, 60, 50, 40, 30, 20, 10, or any intervening value. In one or more embodiments, $R^1$ and $R^2$ are independently selected from substituted or unsubstituted ($C_1$-$C_{20}$) to ($C_1$-$C_{100}$) linear or branched hydrocarbyl, substituted or unsubstituted ($C_3$-$C_{20}$) to ($C_3$-$C_{100}$) cyclohydrocarbyl, substituted or unsubstituted ($C_4$-$C_{20}$) to ($C_4$-$C_{100}$) aryl, and substituted or unsubstituted ($C_1$-$C_{20}$) to ($C_1$-$C_{100}$) linear or branched heterohydrocarbyl.

In one or more embodiments, $R^1$ and $R^2$ are independently selected from ($C_1$-$C_{50}$) alkyl and ($C_1$-$C_{50}$) alkyl-phenyl. For example, $R^1$ and $R^2$ may be independently selected from ($C_1$-$C_{50}$) alkyl, such as methyl, ethyl, propyl, isopropyl, butyl, isobutyl, or tertbutyl. In some embodiments, $R^1$ and $R^2$ may be independently selected from ($C_1$-$C_{50}$) alkyl-phenyl. In embodiments, each of $R^1$ and $R^2$ may be methyl.

In one or more embodiments, $R^1$ and $R^2$ are independently selected from alkoxylated amines according to formula (II):

(II)

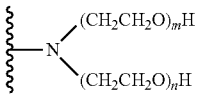

In formula (II), m and n indicate a degree of alkoxylation of the alkoxylated amines. In one or more embodiments, m and n may be independently from 0 to 1000, provided the sum of m and n is greater than zero. In example embodiments, $R^1$, $R^2$, or both, may be alkoxylated amines according to formula (II), in which m and n are independently from 1 to 1000, from 1 to 100, from 1 to 50, from 1 to 20, from 1 to 10, or from 1 to 5.

In formula (I), A is a starter moiety or a terminal group. The starter moiety may be any moiety from which the polymerization of the demulsifier compound may begin. In one or more embodiments, the starter moiety may be a polyol. In one or more embodiments, the starter moiety may be a glycol. For example, the starter moiety may be a dipropylene glycol or a polypropylene glycol. An example terminal group is hydroxyl.

In formula (I), x is a mole fraction of carbonate-link monomers of the demulsifier compound and y is a mole fraction of ether-link monomers of the demulsifier compound. Generally, the carbonate-link monomers comprise a carbonate moiety, where the carbonate moiety is bonded to another monomer of the demulsifier compound, and ether-link monomers comprise an ether moiety, where the ether moiety is bonded to another monomer of the demulsifier compound. Given the presence of carbonate-link monomers in the demulsifier compound, the demulsifier compound may be a polycarbonate.

In one or more embodiments, x may be from 0.001 to 1, and y may be from 0 to 0.999. For example, x may be from 0.001 to 1, from 0.01 to 1, from 0.05 to 1, from 0.10 to 1, from 0.15 to 1, from 0.20 to 1, from 0.25 to 1, from 0.30 to 1, from 0.35 to 1, from 0.40 to 1, from 0.45 to 1, from 0.50 to 1, from 0.55 to 1, from 0.60 to 1, from 0.65 to 1, from 0.70 to 1, from 0.75 to 1, from 0.80 to 1, from 0.85 to 1, from 0.90 to 1, from 0.95 to 1, from 0.99 to 1, from 0.001 to 0.95, from 0.001 to 0.90, from 0.001 to 0.85, from 0.001 to 0.80, from 0.001 to 0.75, from 0.001 to 0.70, from 0.001 to 0.65, from 0.001 to 0.60, from 0.001 to 0.55, from 0.001 to 0.50, from 0.001 to 0.45, from 0.001 to 0.40, from 0.001 to 0.35, from 0.001 to 0.30, from 0.001 to 0.25, from 0.001 to 0.20, from 0.001 to 0.15, from 0.001 to 0.10, or any combination or subset of these ranges. For example, y may be from 0 to 0.999, from 0.01 to 0.999, from 0.05 to 0.999, from 0.10 to 0.999, from 0.15 to 0.999, from 0.20 to 0.999, from 0.25 to 0.999, from 0.30 to 0.999, from 0.35 to 0.999, from 0.40 to 0.999, from 0.45 to 0.999, from 0.50 to 0.999, from 0.55 to 0.999, from 0.60 to 0.999, from 0.65 to 0.999, from 0.70 to 0.999, from 0.75 to 0.999, from 0.80 to 0.999, from 0.85 to 0.999, from 0.90 to 0.999, from 0.95 to 0.999, from 0.99 to 0.999, from 0 to 0.95, from 0 to 0.90, from 0 to 0.85, from 0 to 0.80, from 0 to 0.75, from 0 to 0.70, from 0 to 0.65, from 0 to 0.60, from 0 to 0.55, from 0 to 0.50, from 0 to 0.45, from 0 to 0.40, from 0 to 0.35, from 0 to 0.30, from 0 to 0.25, from 0 to 0.20, from 0 to 0.15, from 0 to 0.10, or any combination or subset of these ranges.

In one or more embodiments, x may be from 0.3 to 0.5 and y may be from 0.5 to 0.7. For example, x may be from 0.3 to 0.5, from 0.35 to 0.5, from 0.4 to 0.5, from 0.45 to 0.5, from 0.3 to 0.45, from 0.3 to 0.4, from 0.3 to 0.35, or any combination or subset of these ranges, and y may be from 0.5 to 0.7, from 0.55 to 0.7, from 0.6 to 0.7, from 0.65 to 0.7, from 0.5 to 0.65, from 0.5 to 0.6, from 0.5 to 0.55, or any combination or subset of these ranges.

In one or more embodiments, the sum of x and y equals 1 ($x+y=1$). In one or more embodiments, the sum of x and y is less than or equal to 1 and greater than or equal to 0.9 ($0.9 \leq x+y \leq 1$). In one or more embodiments, the sum of x and y may be substantially equal to 1. For example, the sum of x and y may be less than or equal to 1 and greater than or equal to 0.90, 0.91, 0.92, 0.93, 0.94, 0.95, 0.96, 0.97, 0.98, 0.99, or any combination or subset of these ranges. Without intending to be bound by theory, various imperfections in the polymerization of the demulsifier compound may introduce impurities or slight variations in to the structure depicted in Formula (I). Accordingly, the sum of x and y may be substantially equal to 1, or slightly less than 1, without adversely impacting the ability of the demulsifier compound to break emulsions.

Alternatively, in formula (1), x may represent the number of carbonate-link monomers, and y may represent the number of ether-link monomers. In such embodiments, x may be from 1 to 5000 and y may be from 0 to 5000. For example, x may be from 1 to 100, from 100 to 500, from 500 to 1000, from 1000 to 2000, from 2000 to 3000, from 3000 to 4000, from 4000 to 5000, or any combination or subset of these ranges, and y may be from 0 to 100, from 100 to 500, from 500 to 1000, from 1000 to 2000, from 2000, to 3000, from 3000 to 4000, from 4000 to 5000, or any combination or subset of these ranges. In such embodiments, the sum of x and y may range from 1 to 10,000.

In formula (I), n refers to a number of repeat units that provides the demulsifier compound a molecular weight from 200 g/mol to 250,000 g/mol. For example, n may refer to a number of repeat units that provides the demulsifier compound a molecular weight from 200 g/mol to 200,000 g/mol, from 200 g/mol to 100,000 g/mol, from 200 g/mol to 50,000 g/mol, from 200 g/mol to 25,000 g/mol, from 200 g/mol to 10,000 g/mol, from 200 g/mol to 5000 g/mol, from 500 g/mol to 10,000 g/mol, of from 500 g/mol to 5000 g/mol, or any combination or subset of these ranges. In one or more embodiments, n may be from 2 to 100. For example, n may be from 2 to 100, from 10 to 100, from 20 to 100, from 30 to 100, from 40 to 100, from 50 to 100, from 60 to 100, from 70 to 100, from 80 to 100, from 90 to 100, from 2 to 90, from 2 to 80, from 2 to 70, from 2 to 60, from 2 to 50, from 2 to 40, from 2 to 30, from 2 to 20, from 2 to 10, or any combination or subset of these ranges.

The demulsifier compound of formula (I) may be produced by polymerizing carbon dioxide and an epoxide. An exemplary but non-limiting polymerization reaction of carbon dioxide and an alkylene oxide or epoxide is provided in Reaction Scheme 1:

Reaction Scheme 1: Copolymerization of carbon dioxide and alkylene oxide

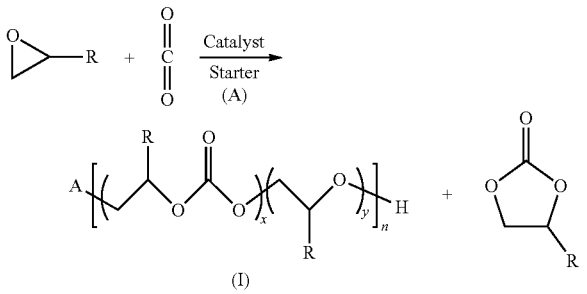

By Reaction Scheme 1, an alkylene oxide is reacted with carbon dioxide in the presence of a catalyst and a starter compound A to form a polymer according to formula (I) and an alkylene carbonate as a byproduct. By controlling the reaction conditions, relative concentrations of alkylene oxide and carbon dioxide, the catalyst, and the starter compound A, the relative amounts of carbonate-link monomers (subscript x) and ether-link monomers (subscript y), as well as the number of repeat units (subscript n) that determine overall molecular weight may be controlled. It should be understood by those skilled in the art that, though the Reaction Scheme 1 for illustrative purposes demonstrates reaction of only a single alkylene oxide with the carbon dioxide such that all groups R are identical in the Reaction Scheme, a mixture of alkylene oxide reactants may be reacted to provide products in which the groups R are not necessarily identical.

The epoxide may be any functionalized oxirane ring, including, but not limited to, propylene oxide. In one or more embodiments, the functional group on the oxirane ring (R in Reaction Scheme 1) may be substituted or unsubstituted ($C_1$-$C_{20}$) to ($C_1$-$C_{100}$) linear or branched hydrocarbyl, substituted or unsubstituted ($C_3$-$C_{20}$) to ($C_3$-$C_{100}$) cyclohydrocarbyl, substituted or unsubstituted ($C_4$-$C_{20}$) to ($C_4$-$C_{100}$) aryl, and substituted or unsubstituted ($C_1$-$C_{20}$) to ($C_1$-$C_{100}$) linear or branched heterohydrocarbyl. In embodiments, the value "y" in the form "($C_x$-$C_y$)" may be 1000, 700, 500, 300, 200, 100, 90, 80, 70, 60, 50, 40, 30, 20, 10, 5, 4, 3, 2, 1, or any intervening value for the hydrocarbyl, cyclohydrocarbyl, aryl, or heterohydrocarbyl of R in Reaction Scheme 1.

The carbon dioxide and epoxide may be polymerized in the presence of a catalyst and a starter moiety. As previously described, the starter moiety may be any moiety from which the polymerization of the demulsifier compound may begin. For example, the starter moiety may be a glycol, such as a dipropylene glycol or a polypropylene glycol. The catalyst may be any compound or industrial catalyst system that catalyzes the copolymerization of propylene oxide and carbon dioxide, of which many are known.

The emulsion-breaking solution may further comprise an organic solvent. The organic solvent may be any solvent capable of dissolving the demulsifier compound. For example, the organic solvent may comprise naphtha, xylene, isobutanol, methanol, or combinations thereof. In one or more embodiments, the emulsion-breaking solution may comprise the demulsifier compound of formula (I) at a concentration from 50 parts per million (ppm) to 2000 ppm in the organic solvent, where the ppm is measured by weight, based on the total weight of the emulsion-breaking solution. For example, the emulsion-breaking solution may comprise the demulsifier compound of formula (I) at a concentration from 50 ppm to 2000 ppm, from 200 ppm to 2000 ppm, from 400 ppm to 2000 ppm, from 600 ppm to 2000 ppm, from 800 ppm to 2000 ppm, from 1000 ppm to 2000 ppm, from 1200 ppm to 2000 ppm, from 1400 ppm to 2000 ppm, from 1600 ppm to 2000 ppm, from 1800 ppm to 2000 ppm, from 50 ppm to 1800 ppm, from 50 ppm to 1600 ppm, from 50 ppm to 1400 ppm, from 50 ppm to 1200 ppm, from 50 ppm to 1000 ppm, from 50 ppm to 800 ppm, from 50 ppm to 600 ppm, from 50 ppm to 400 ppm, from 50 ppm to 200 ppm, or any combination or subset of these ranges.

In embodiments, the emulsion-breaking solution may be substantially free of polycarbonates comprising bisphenol-A monomers, phosgene-based monomers, or combinations thereof. Generally, polycarbonates may be formed by a reaction of bisphenol-A and phosgene, which results in a polycarbonate comprising bisphenol-A monomers and phosgene-based monomers. Such polycarbonates generally do not incorporate carbon dioxide into the polymer. Accordingly, when polycarbonates comprising bisphenol-A monomers, phosgene-based monomers, or combinations thereof are used instead of, or in addition to, the demulsifier compound formed from carbon dioxide, less carbon dioxide is used as a value added product during demulsification methods contemplated herein.

Contacting the emulsion with the emulsion-breaking solution may result in the coalescence of the dispersed phase such that a discrete boundary is obtained between an aqueous phase and an oleaginous phase. In embodiments, this coalescence may occur in the same vessel as the contacting or mixing of the emulsion with the emulsion-breaking solution. In alternative embodiments, the coalescence may occur at least partially in a second vessel, separate from the vessel in which the emulsion and emulsion-breaking solution are mixed. Suitable second vessels for the coalescence of the dispersed phase include tanks, vats, barrels, settlers, separatory funnels, tubes, or any other suitable vessels.

In embodiments, the aqueous phase may include water, such as fresh water, salt water, formation water, or produced water, and the oleaginous phase may comprise crude oil. In one or more embodiments, the discrete boundary may be an interface where the aqueous phase contacts the oleaginous phase. Alternatively, the discrete boundary may be a third phase that contacts both the aqueous phase and the oleaginous phase. The third phase may contain solids. Such a solids containing phase may form from solids present in the crude oil.

In one or more embodiments, the methods for breaking emulsions may further comprise separating the aqueous phase from the oleaginous phase. Separation of the aqueous phase from the oleaginous phase generally includes removing at least a portion of the aqueous phase, at least a portion of the oleaginous phase, or both from the vessel containing the aqueous phase and the oleaginous phase. This separation may be achieved by any suitable means, including but not limited to decantation, skimming, and siphoning. Separating the aqueous phase from the oleaginous phase may mitigate the undesirable consequences of processing crude oil with a high water content. For example, separating water from the crude oil may result in less corrosion of refinery equipment, less poisoning of catalyst in downstream processing facilities, and decreased the pumping costs.

EXAMPLES

The examples are representative of embodiments of the presently disclosed subject matter, and are not meant as limiting the scope of the claims.

In the following Examples, emulsion-breaking solutions were prepared from two demulsifier compounds according to formula (I) as previously described. Demulsifier A was a demulsifier compound according to formula (I) in which $R^1$ and $R^2$ both were methyl, prepared by polymerizing propylene oxide and carbon dioxide, and having a molecular weight of 1000 g/mol. Demulsifier B was a demulsifier compound according to formula (I) in which $R^1$ and $R^2$ both were methyl, prepared by polymerizing propylene oxide and carbon dioxide, and having a molecular weight of 2000 g/mol.

Example 1

Breaking of a Laboratory Emulsion

A crude oil emulsion was prepared in a laboratory using a crude oil having an API gravity of 33.4° at 15.6° C. A mixture was prepared by adding water to the crude oil such that the mixture was 40% water and 60% crude oil. The mixture was stirred overnight at a temperature of 25° C. to form the emulsion. The emulsion was allowed to settle for three hours and no separation of the water and oil was observed, indicating the formation of a stable emulsion.

Emulsion-breaking solutions were prepared from Demulsifier A and Demulsifier B by adding 250 mg of the respective Demulsifier to a solvent system of 4 mL of naphtha, 2 mL of xylene, 2 mL of iso-butanol, and 1 mL of methanol. A solvent control sample was prepared without a demulsifier. The solvent control sample was prepared by mixing 4 mL of naphtha, 2 mL of xylene, 2 mL of iso-butanol, and 1 mL of methanol.

Test samples of the crude oil emulsion were mixed with each of the emulsion-breaking solutions and with the solvent control. To prepare the test samples, 50 mL of the crude oil emulsion was added to each of four 100-mL graduated settling tubes. The emulsion-breaking solution containing Demulsifier A was added to the first graduated settling tube to achieve a demulsifier concentration of 540 ppm. The emulsion-breaking solution containing Demulsifier B was added to the second graduated settling tube to achieve a demulsifier concentration of 1080 ppm. To the third graduated settling tube, 2 mL of the solvent system sample was added. The fourth graduated settling tube served as a blank control and included only the crude oil emulsion.

Each of the four graduated settling tubes was shaken by hand for 1 minute to 5 minutes to mix the contents of the tubes. The tubes then were placed in a water bath held at a temperature of 60° C. The volume of water that separated from the emulsion was measured over time. The results are provided in Table 1.

TABLE 1

Demulsification of the Laboratory Emulsion

| | | | Volume of separated water at 60° C. (mL) | | | | | | | |
|---|---|---|---|---|---|---|---|---|---|---|
| S. No | Demulsifier | Conc. of Demulsifier | 15 min | 30 min | 45 min | 60 min | 65 min | 80 min | After strong mixing | % water separated |
| 1 | Sample A | 540 ppm | 2 | 2 | 4 | 5 | 5 | 6 | 10 | 50% |
| 2 | Sample B | 1080 ppm | 7 | 7 | 10 | 12 | 13 | 14 | 15 | 75% |
| 3 | Solvent control | 2 mL | 0 | 0 | 0 | 0 | 0 | 0 | 0 | 0% |
| 4 | Blank | NA | 0 | 0 | 0 | 0 | 0 | 0 | 0 | 0% |

After 80 minutes had elapsed, the tubes were subjected to strong mixing in a centrifuge at a rotational speed of about 5000 rpm to further separate water from the emulsion. The results are also included in Table 1.

The results summarized in Table 1 demonstrate that both emulsion-breaking solutions successfully broke the laboratory-prepared crude oil emulsion. Further, the percentage of water separated from the emulsion did not change even after strong mixing, indicating that the compounds according to formula (I) are strong demulsifiers.

Example 2

Breaking of a Field Emulsion

A field emulsion sample was collected from a production header. The field emulsion was 50% water. The field emulsion was allowed to settle overnight at 25° C., after which time no separation of the water and oil was observed, indicating that the field emulsion was a stable emulsion.

Emulsion-breaking solutions were prepared from Demulsifier A and Demulsifier B by adding 200 mg of the respective Demulsifier to a solvent system of 10 mL of xylene and 0.5 mL of methanol. A solvent control sample without a demulsifier. The solvent control sample was prepared by mixing 10 mL of xylene and 0.5 mL of methanol.

Test samples of the field emulsion were mixed with each of the emulsion-breaking solutions and with the solvent control. To prepare the test samples, 50 mL of the field emulsion was added to each of four 100-mL graduated settling tubes. To one tube, the emulsion-breaking solution containing Demulsifier A was added to achieve a demulsifier concentration of 200 ppm. To a second tube, the emulsion-breaking solution containing Demulsifier B was added to achieve a demulsifier concentration of 200 ppm. To the third graduated settling tube, 2 mL of the solvent system sample was added. The fourth graduated settling tube served as a blank control and included only the field emulsion.

Each of the four graduated settling tubes was shaken by hand for 1 minute to 5 minutes to mix the contents of the tubes. The tubes then were placed in a water bath held at a temperature of 60° C. The volume of water that separated from the emulsion was measured over time. The results are provided in Table 2.

TABLE 2

Demulsification of the Field Emulsion

| S. No | Emulsion breaker/ Demulsifier | Cone of Demulsifier | Amount/volume (mL) of separated water at 60° C. 15 min | 30 min | 45 min | 60 min | % water separated after 60 min |
|---|---|---|---|---|---|---|---|
| 1 | Sample A | 200 ppm | 3 | 12 | 15 | 18 | 72% |
| 2 | Sample B | 200 ppm | 4 | 15 | 15 | 20 | 80% |
| 3 | Solvent control | 2 mL | 0 | 0 | 0 | 0 | 0% |
| 4 | Blank | NA | 0 | 0 | 0 | 0 | 0% |

The results of Table 2 indicate again that both emulsion-breaking solutions successfully broke the field emulsion. The emulsion-breaking solution containing the Demulsifier B with a 2000 g/mol molecular weight performed slightly better than the emulsion-breaking solution containing the Demulsifier A with a 1000 g/mol molecular weight.

In a first aspect of the present disclosure, a method for breaking an emulsion may include contacting the emulsion with an emulsion-breaking solution to coalesce the dispersed phase and obtain a discrete boundary between an aqueous phase and an oleaginous phase. The emulsion may include a continuous phase and a dispersed phase dispersed within the continuous phase. The emulsion-breaking solution includes a demulsifier compound according to formula (I). $R^1$ and $R^2$ are independently selected from substituted or unsubstituted ($C_1$-$C_{50}$) linear or branched hydrocarbyl, substituted or unsubstituted ($C_3$-$C_{50}$) cyclohydrocarbyl, substituted or unsubstituted ($C_4$-$C_{50}$) aryl, —$NH_2$, alkyl amines, alkoxylated amines, and substituted or unsubstituted ($C_1$-$C_{50}$) linear or branched heterohydrocarbyl. A is a starter moiety or a terminal group. x is a mole fraction of carbonate-link monomers of the demulsifier compound. y is a mole fraction of ether-link monomers of the demulsifier compound. x is from 0.001 to 1, y is from 0 to 0.999, and x+y=1. n is a number of repeat units that provides the demulsifier compound a molecular weight from 200 g/mol to 250,000 g/mol.

A second aspect of the present disclosure may include the first aspect, wherein the method includes separating the aqueous phase from the oleaginous phase.

A third aspect of the present disclosure may include the first or second aspects, wherein the continuous phase includes water and the dispersed phase includes oil.

A fourth aspect of the present disclosure may include the first or second aspects, wherein the continuous phase includes oil and the dispersed phase includes water.

A fifth aspect of the present disclosure may include any of the first through fourth aspects, wherein the oleaginous phase includes crude oil.

A sixth aspect of the present disclosure may include any of the first through fifth aspects, wherein the emulsion-breaking solution includes an organic solvent.

A seventh aspect of the present disclosure may include the sixth aspect, wherein the emulsion-breaking solution includes the demulsifier compound at a concentration from 50 ppm to 2000 ppm in the organic solvent, where ppm is measured by weight, based on the total weight of the emulsion-breaking solution.

An eighth aspect of the present disclosure may include the sixth or seventh aspects, wherein the organic solvent includes naphtha, xylene, isobutanol, methanol, or combinations thereof.

A ninth aspect of the present disclosure may include any of the first through eighth aspects, wherein x is from 0.001 to 0.999 and y is from 0.001 to 0.999.

A tenth aspect of the present disclosure may include any of the first through ninth aspects, wherein x is from 0.3 to 0.5 and y is from 0.5 to 0.7.

An eleventh aspect of the present disclosure may include any of the first through tenth aspects, wherein x is from 0.8 to 1 and y is from 0 to 0.2.

A twelfth aspect of the present disclosure may include any of the first through eleventh aspects, wherein A is a polyol or a hydroxyl terminal group.

A thirteenth aspect of the present disclosure may include any of the first through twelfth aspects, wherein A is a glycol.

A fourteenth aspect of the present disclosure may include any of the first through thirteenth aspects, wherein A is a dipropylene glycol or a polypropylene glycol.

A fifteenth aspect of the present disclosure may include any of the first through fourteenth aspects, wherein $R^1$ and $R^2$ are independently selected from the group consisting of ($C_1$-$C_{50}$) alkyl, ($C_1$-$C_{50}$) alkyl-phenol, and ethoxylated amines.

A sixteenth aspect of the present disclosure may include any of the first through fifteenth aspects, wherein $R^1$ is methyl and $R^2$ is methyl.

A seventeenth aspect of the present disclosure may include any of the first through sixteenth aspects, wherein y is 0 and $R^1$ is methyl.

An eighteenth aspect of the present disclosure may include any of the first through seventeenth aspects, wherein n is a number of repeat units that provides the demulsifier compound a molecular weight from 200 g/mol to 10,000 g/mol An nineteenth aspect of the present disclosure may include any of the first through eighteenth aspects, wherein the emulsion-breaking solution is substantially free of polycarbonates including bisphenol-A monomers, phosgene-based monomers, or combinations thereof.

The subject matter of the present disclosure has been described in detail and by reference to specific embodiments. It should be understood that any detailed description of a component or feature of an embodiment does not necessarily imply that the component or feature is essential to the particular embodiment or to any other embodiment.

It is noted that one or more of the following claims utilize the term "wherein" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

It should be understood that where a first component is described as "comprising" or "including" a second component, it is contemplated that, in some embodiments, the first component "consists" or "consists essentially of" the second component. It should further be understood that where a first component is described as "comprising" a second component, it is contemplated that, in some embodiments, the first component comprises at least 10%, at least 20%, at least 30%, at least 40%, at least 50%, at least 60%, at least 70%, at least 80%, at least 90%, at least 95%, or even at least 99% that second component (where % can be weight % or molar %).

Additionally, the term "consisting essentially of" is used in this disclosure to refer to quantitative values that do not materially affect the basic and novel characteristic(s) of the disclosure.

It should be understood that any two quantitative values assigned to a property or measurement may constitute a range of that property or measurement, and all combinations of ranges formed from all stated quantitative values of a given property or measurement are contemplated in this disclosure.

What is claimed is:

1. A method for breaking an emulsion comprising a continuous phase and a dispersed phase dispersed within the continuous phase, the method comprising:

contacting the emulsion with an emulsion-breaking solution to coalesce the dispersed phase and obtain a discrete boundary between an aqueous phase and an oleaginous phase, wherein:

the emulsion-breaking solution comprises a demulsifier compound according to

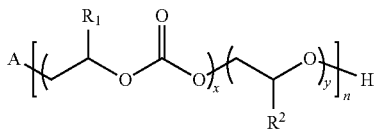

(I)

where:

$R^1$ and $R^2$ are independently selected from substituted or unsubstituted ($C_1$-$C_{50}$) linear or branched hydrocarbyl, substituted or unsubstituted ($C_3$-$C_{50}$) cyclohydrocarbyl, substituted or unsubstituted ($C_4$-$C_{50}$) aryl, —$NH_2$, alkyl amines, alkoxylated amines, and substituted or unsubstituted ($C_1$-$C_{50}$) linear or branched heterohydrocarbyl;

A is a starter moiety or a terminal group;

x is a mole fraction of carbonate-link monomers of the demulsifier compound;

y is a mole fraction of ether-link monomers of the demulsifier compound;

x is from 0.001 to 1;

y is from 0 to 0.999;

x+y=1; and n is a number of repeat units that provides the demulsifier compound a molecular weight from 200 g/mol to 250,000 g/mol.

2. The method of claim 1, wherein the method further comprises separating the aqueous phase from the oleaginous phase.

3. The method of claim 1, wherein the continuous phase comprises water and the dispersed phase comprises oil.

4. The method of claim 1, wherein the continuous phase comprises oil and the dispersed phase comprises water.

5. The method of claim 1, wherein the oleaginous phase comprises crude oil.

6. The method of claim 1, wherein the emulsion-breaking solution further comprises an organic solvent.

7. The method of claim 6, wherein the emulsion-breaking solution comprises the demulsifier compound at a concentration from 50 ppm to 2000 ppm in the organic solvent, where ppm is measured by weight, based on the total weight of the emulsion-breaking solution.

8. The method of claim 6, wherein the organic solvent comprises naphtha, xylene, isobutanol, methanol, or combinations thereof.

9. The method of claim 1, wherein x is from 0.001 to 0.999 and y is from 0.001 to 0.999.

10. The method of claim 1, wherein x is from 0.3 to 0.5 and y is from 0.5 to 0.7.

11. The method of claim 1, wherein x is from 0.8 to 1 and y is from 0 to 0.2.

12. The method of claim 1, wherein A is a polyol or a hydroxyl terminal group.

13. The method of claim 1, wherein A is a glycol.

14. The method of claim 1, wherein A is a dipropylene glycol or a polypropylene glycol.

15. The method of claim 1, wherein $R^1$ and $R^2$ are independently selected from the group consisting of ($C_1$-$C_{50}$) alkyl, ($C_1$-$C_{50}$) alkyl-phenol, and ethoxylated amines.

16. The method of claim 1, wherein $R^1$ is methyl and $R^2$ is methyl.

17. The method of claim 1, wherein y is 0 and $R^1$ is methyl.

18. The method of claim 1, wherein n is a number of repeat units that provides the demulsifier compound a molecular weight from 200 g/mol to 10,000 g/mol.

19. The method of claim 1, wherein the emulsion-breaking solution is substantially free of polycarbonates comprising bisphenol-A monomers, phosgene-based monomers, or combinations thereof.

* * * * *